US006347198B1

(12) United States Patent
Yamamoto et al.

(10) Patent No.: US 6,347,198 B1
(45) Date of Patent: Feb. 12, 2002

(54) IMAGE FORMING APPARATUS HAVING DEVELOPER AMOUNT DETECTING MEANS AND CARTRIDGE DETACHABLY MOUNTABLE ON THE APPARATUS HAVING A MEMORY FOR STORING INFORMATION ON THE AMOUNT OF DEVELOPER DETECTED BY DETECTING MEANS

(75) Inventors: Shinya Yamamoto; Hiroshi Sasame, both of Numazu; Soya Endo, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/654,391

(22) Filed: Sep. 1, 2000

(30) Foreign Application Priority Data

Sep. 3, 1999 (JP) ..... 11-250779

(51) Int. Cl.[7] ..... G03G 15/08
(52) U.S. Cl. ..... 399/27
(58) Field of Search ..... 399/27, 12, 61

(56) References Cited

U.S. PATENT DOCUMENTS 5,160,966 A * 11/1992 Shiina et al. ..... 399/27
5,699,494 A * 12/1997 Colbert et al. ..... 358/1.15
5,794,094 A * 8/1998 Boockholdt et al. ..... 399/27
6,014,536 A 1/2000 Ban et al. ..... 399/258

FOREIGN PATENT DOCUMENTS

JP 10-247012 * 9/1998
JP 2000-181214 * 6/2000

* cited by examiner

*Primary Examiner*—Joan Pendegrass
(74) *Attorney, Agent, or Firm*—Fitzpatrick, Cella, Harper & Scinto

(57) ABSTRACT

An image forming apparatus has a developer container for containing a developer, a developer amount detecting device for detecting the amount of the developer contained in the developer container, a consumed amount calculating device for calculating the consumed amount of the developer, and a remaining amount calculating device for calculating the remaining amount of the developer from an output of the detecting device and an output of the consumed amount calculating device.

10 Claims, 8 Drawing Sheets

IMAGE FORMING APPARATUS HAVING DEVELOPER AMOUNT DETECTING MEANS AND CARTRIDGE DETACHABLY MOUNTABLE ON THE APPARATUS HAVING A MEMORY FOR STORING INFORMATION ON THE AMOUNT OF DEVELOPER DETECTED BY DETECTING MEANS

BACKGROUND OF THE INVENTION

1. Field of the Invention

The present invention relates to an image forming apparatus in which an electrostatic latent image is formed on an image bearing member, for example, by electrophotography and such an electrostatic latent image is visualized with developer by a developing apparatus, and more particularly, it relates to an image forming apparatus including a developer amount detecting device having developer remaining amount detecting means capable of successively detecting a remaining amount of developer contained in a developer container, and a cartridge attachable to such an image forming apparatus, i.e., a process cartridge and a developing apparatus in a form of a cartridge.

The electrophotographic image forming apparatus may include, for example, an electrophotographic copying machine, an electrophotographic printer (for example, an LED printer, a laser beam printer or the like), an electrophotographic facsimile and the like.

Further, the process cartridge is provided by integrally making an electrophotographic photosensitive member and at least one of charging means, developing means, and cleaning means into a cartridge and is detachably attachable to a main body of an electrophotographic image forming apparatus, or is provided by integrally making an electrophotographic photosensitive member and at least developing means into a cartridge and is detachably attachable to a main body of an electrophotographic image forming apparatus.

2. Related Background Art

In the past, a process cartridge in which an electrophotographic photosensitive member and process means acting on the electrophotographic photosensitive member are integrally incorporated as a cartridge unit, which is detachably attachable to a main body of an electrophotographic image forming apparatus, has been used in an image forming apparatus using an electrophotographic image forming process. According to such a process-cartridge system, since the maintenance of the apparatus can be performed by the user (operator) himself without any serviceman, operability can be enhanced considerably. Thus, the process-cartridge system has widely been used in the electrophotographic image forming apparatus.

In the electrophotographic image forming apparatus using such a process-cartridge system, if the developer is used up, although image formation is permitted again by exchanging the empty cartridge for a new one, since the cartridge must be exchanged by the operator himself, it is required that means be provided for informing the operator of the fact that the developer is used up, i.e., a developer amount detecting device should be provided.

Regarding the developer amount detecting device, in order to always know the remaining amount of developer capable of being applied to image formation, developer remaining amount detecting means, capable of detecting a developer remaining amount level, are provided in the cartridge or the main body of the image forming apparatus.

As one of the developer remaining amount detecting means, there is a capacitance detecting system. In this system, an antenna for detecting the developer remaining amount is located within a developer container, and the remaining amount of the developer is detected by utilizing a change in current generated in the antenna in accordance with the amount of the developer between an electrode and the antenna when AC voltage is applied to an electrode provided at a predetermined location.

For example, as an example using a capacitance detecting system, there is a flat antenna system. As shown in FIG. 3, a flat antenna 20 is obtained by forming a pair of conductive patterns 22, 23 on a substrate 21 with a predetermined interval, and, for example, the flat antenna is located at a position where it contacts developer at the side surface of the developer container so that the contact area between the developer and the flat antenna 20 is decreased as the developer in the developer container is decreased.

The capacitance is changed by the change in the contact area between the conductive pattern surface and the developer as a result of consumption of the developer. Thus, the remaining amount of the developer in the container can correspond to the capacitance of the flat antenna, with the result that the remaining amount of the developer in the container can always be known by measuring the capacitance of the flat antenna.

The capacitance of the flat antenna 20 can be determined from current flowing through one of a pair of conductive portions 22, 23 when a predetermined AC bias is applied to the other conductive portion.

Further, as another example using the capacitance detecting system, there is a plate antenna system constituted by a metal plate (plate antenna) disposed in parallel with a developing roller as a developer carrying member provided within a developer container, in a so-called jumping developing system in which a latent image on a photosensitive member is developed by applying an AC bias to the developing roller.

The plate antenna system utilizes the fact that the capacitance between the plate antenna and the developing roller is changed in accordance with an amount of the developer existing between the plate antenna and the developing roller. If a space between the plate antenna and the developing roller is filled with the developer, the capacitance becomes great, and, as the amount of the developer is decreased, the amount of air between the plate antenna and the developing roller is increased, thereby decreasing the capacitance. Accordingly, by previously determining the relationship between the capacitance between the plate antenna and the developing roller and the amount of the developer, the amount of the developer can be known.

In a method for measuring the capacitance, the capacitance can be sought by measuring current flowing through the plate antenna when the AC bias, as a developing bias, is applied to the developing roller. Namely, the developer remaining amount detecting system can detect the remaining amount of the developer during image formation in which the developing bias is being applied to the developing roller.

By providing the above-mentioned developer remaining amount detecting means on a developer containing portion, i.e., the developer container, the amount of the developer capable of being supplied for the image formation can always be known, and, at the same time, it can always be known how many copies can be obtained from now.

Further, as the developer remaining amount detecting means, there is a torque detecting system in which developer agitating means are provided within a developer container and the remaining amount of developer is detected by utilizing a change in the load acting on the developer agitating means in accordance with the remaining amount of the developer.

However, in all of the above-mentioned developer remaining amount detecting systems, although the developer remaining amount level can be detected, satisfactory detecting accuracy cannot be obtained due to a limitation on the measurement resolving power and measuring error.

In particular, there is a need for means capable of effecting display with high resolving power (resolution) when the exchanging time of the process cartridge approaches and capable of correctly detecting the developer remaining amount whenever the process cartridge is exchanged.

The present invention relates to further improvement of such an image forming apparatus and a process cartridge detachably attachable (mountable) to the image forming apparatus.

SUMMARY OF THE INVENTION

The present invention aims to eliminate the abovementioned conventional drawbacks, and an object of the present invention is to provide an image forming apparatus and a cartridge detachably attachable to such as image forming apparatus, in which the remaining amount of developer can be detected correctly.

Another object of the present invention is to provide an image forming apparatus and a cartridge detachably attachable to such as image forming apparatus, in which the remaining amount of developer can be displayed correctly.

A further object of the present invention is to provide an image forming apparatus and a cartridge detachably attachable to such as image forming apparatus, in which the remaining amount of developer can be displayed with a high resolving power.

A still further object of the present invention is to provide an image forming apparatus comprising a developer container for containing a developer, developer amount detecting means for detecting the amount of the developer contained in the developer container, consumed amount calculating means for calculating the consumed amount of the developer, and remaining amount calculating means for calculating the remaining amount of the developer from the output of the detecting means and the output of the consumed amount calculating means.

A further object of the present invention is to provide a cartridge comprising a developer container, and a memory for storing information regarding an amount of developer detected by detecting means for detecting the amount of the developer contained in the developer container and information calculated by consumed amount calculating means for calculating a consumed amount of the developer.

The other objects and features of the present invention will be apparent from the following detailed explanation of the intention referring to the accompanying drawings.

DETAILED DESCRIPTION OF THE PREFERRED EMBODIMENTS

Figure 1:
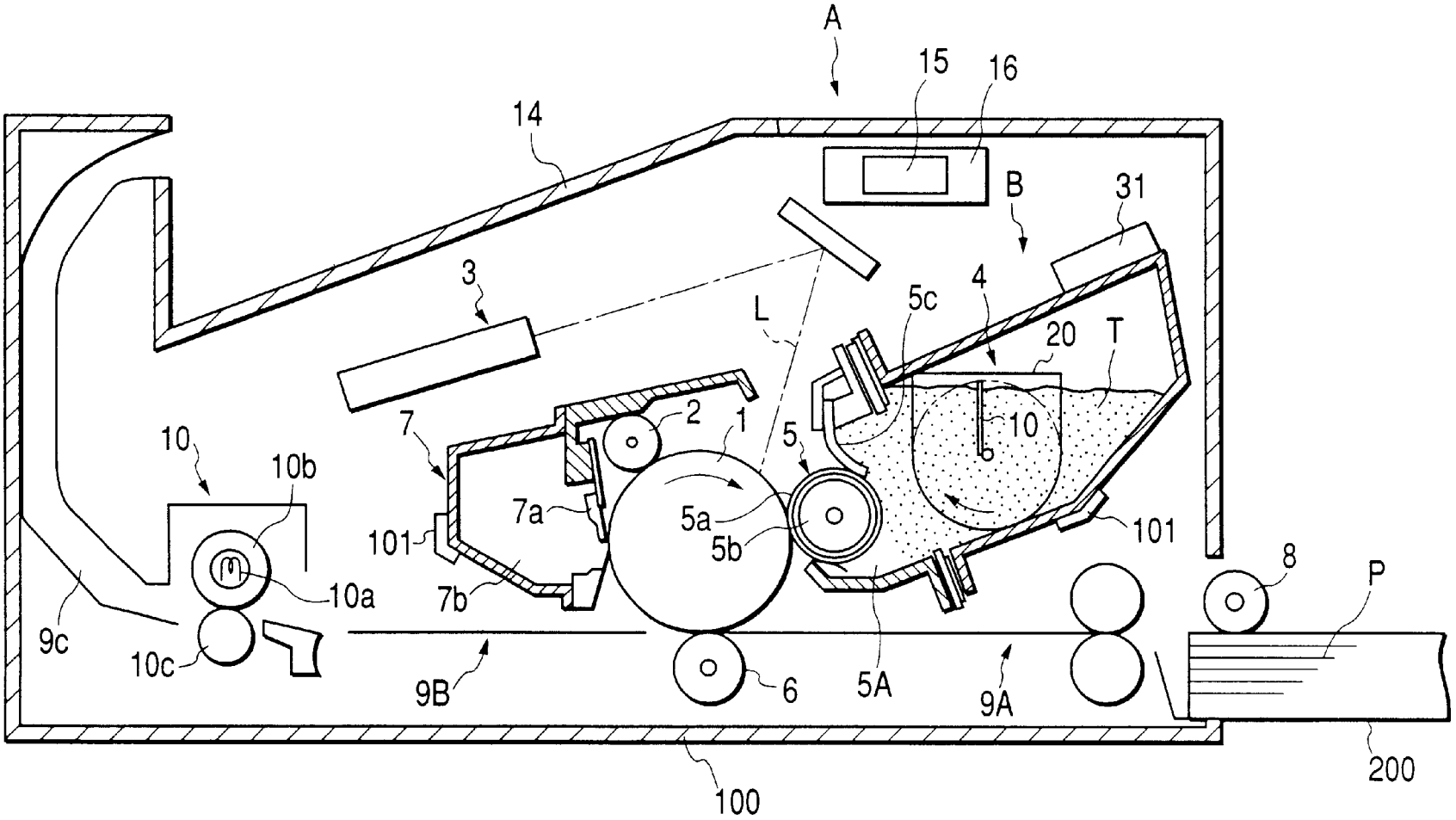
FIG. 1 is a sectional view showing a process cartridge and an image forming apparatus according an embodiment of the present invention.

Now, an image forming apparatus and a cartridge detachably attachable to such an image forming apparatus according to the present invention will be fully explained with reference to the accompanying drawings.

First Embodiment

First of all, an embodiment of an electrophotographic image forming apparatus to which a process cartridge is detachably attachable will be described with reference to FIGS. 1 to 3. In this embodiment, the electrophotographic image forming apparatus is embodied as a laser beam printer A of the electrophotographic type in which an image is formed on a recording medium such as a recording paper, an OHP sheet or cloth by an electrophotographic image forming process.

The laser beam printer A includes a drum-shaped electrophotographic photosensitive member, i.e., an photosensitive drum 1. A latent image corresponding to image information is formed on the photosensitive drum 1 by charging the photosensitive drum by means of a charging roller 2 as charging means and then by illuminating the photosensitive drum with a laser beam L corresponding to the image information from a laser scanner 3. The latent image is developed or visualized by developing means 5 as a toner image.

The developing means 5 comprise a developing chamber 5A including a developing roller 5*a* as a developer carrying member. Developer T in a developer container 4, as a developer containing portion adjacent to the developing chamber 5A, is fed to the developing roller 5*a* within the developing chamber 5A by rotation of a developer feeding member 10. In the illustrated embodiment, insulative one-component toner is used as the developer T. Further, the developing roller 5*a* includes a fixed magnet 5*b* therein. The developer is carried by rotating the developing roller 5*a*. Frictional charges are applied to the developer by a developing blade 5*c* and a developer layer having a predetermined thickness is formed. Then, the developer as the developer layer is supplied to a developing area for the photosensitive drum 1. The developer supplied to the developing area is transferred to the latent image on the photosensitive drum 1, thereby forming the toner image. The developing roller 5*a* is connected to a developing bias circuit so that developing bias voltage obtained by overlapping DC voltage on AC voltage is normally applied to the developing roller.

On the other hand, in synchronism with the formation of the toner image, a recording medium P contained in a sheet feeding cassette 200 is conveyed to a transfer position via a pick-up roller 8 and conveying means 9A. A transfer roller 6 as transfer means is disposed at the transfer position, and, by applying voltage to the transfer roller, the toner image on the photosensitive drum 1 is transferred onto the recording medium P.

The recording medium P to which the toner image was transferred is conveyed to fixing means 10 by conveying means 9B. The fixing means 10 comprises a fixing roller 10*b* including a heater 10*a* therein, and a drive roller 10*c*. While the recording medium is being passed through the fixing means, the transferred toner image is fixed to the recording medium P by heat and pressure.

The recording medium P is discharged onto a discharge tray 14 by conveying means 9C. The discharge tray 14 is provided on an upper surface of a main body 100 of the laser beam printer A.

After the toner image was transferred to the recording medium P by the transfer roller 6, the developer remaining on the photosensitive drum 1 is removed by cleaning means 7 for preparing for the next image forming process. In the cleaning means 7, the residual developer on the photosensitive drum 1 is scraped off by an elastic cleaning blade 7*a* abutting against the photosensitive drum 1, and the scraped off developer is collected into a waste developer reservoir 7*b*.

Figure 3:
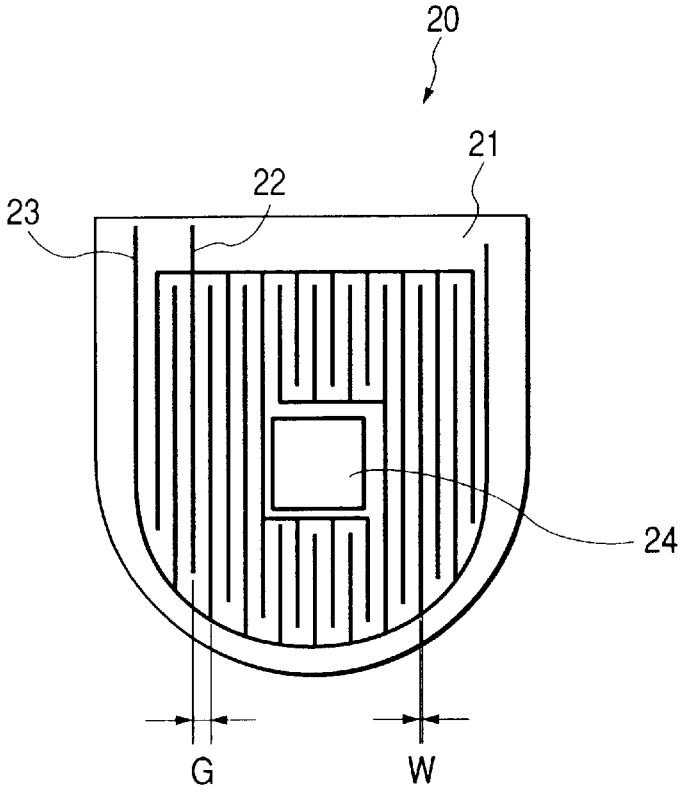
FIG. 3 is a view showing developer remaining amount detecting means capable of being mounted to the process cartridge according to the present invention.

On the other hand, in the illustrated embodiment, as shown in FIG. 3, a process cartridge B is constituted by forming a developing unit obtained by welding (fusion-coupling) a developer frame 11, having the developer container 4 containing the developer, to a developing frame 12 holding the developing means 5 including the developing roller 5*a* and the developing blade 5*c* and then by integrally coupling a cleaning frame 13, to which the photosensitive drum 1 and the cleaning means 7 including the cleaning blade 7*a* are attached, to the developing unit.

The process cartridge B is detachably mounted to cartridge mounting means 101 (FIG. 1) of the main body 100 of the image forming apparatus by the operator.

Figure 4:
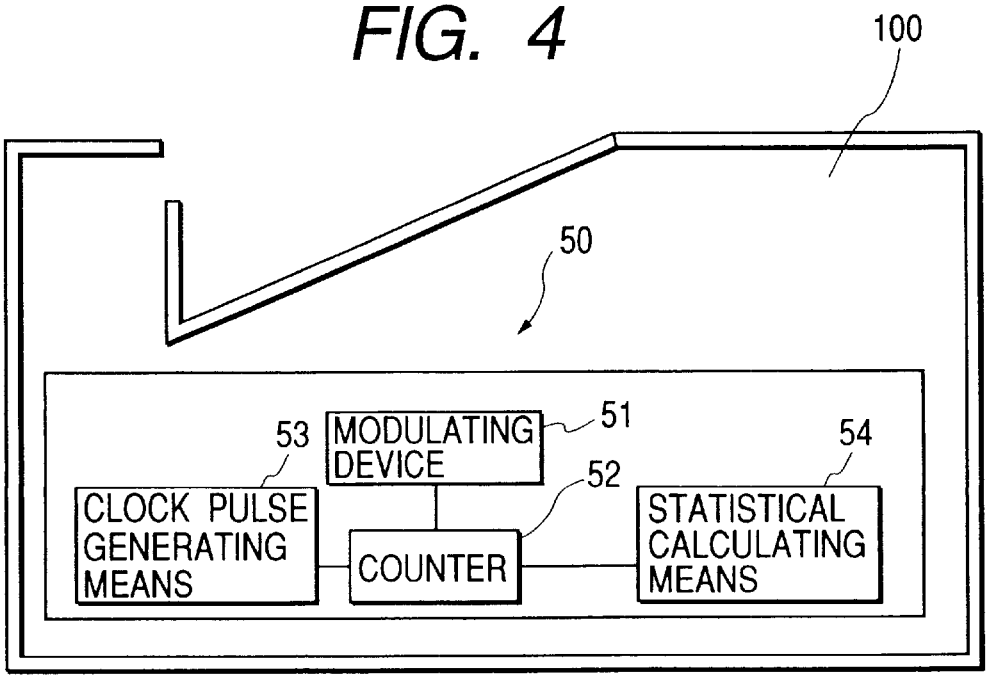
FIG. 4 is a schematic constructural view of means for successively calculating the developer remaining amount level on the basis of a statistical calculation used in the present invention.

According to the present invention, as shown in FIG. 4, the process cartridge B has a developer amount detecting device 30 including developer remaining amount detecting means 20 capable of successively detecting the remaining amount of the developer decreased as the developer T in the developer container 4 is consumed.

According to the illustrated embodiment, in order to achieve developer remaining amount detection with high resolving power and to correctly inform the operator of a developer remaining amount level even when the process cartridge is exchanged for a new one, the main body of the image forming apparatus is provided with means for detecting a developer consumed amount by statistical calculation, and the process cartridge is provided with the developer remaining amount detecting means and memory means. Further, in the illustrated embodiment, as the developer amount detecting device 30, an electrostatic capacity detecting system using a flat antenna, as the developer remaining amount detecting means, is provided.

Figure 2:
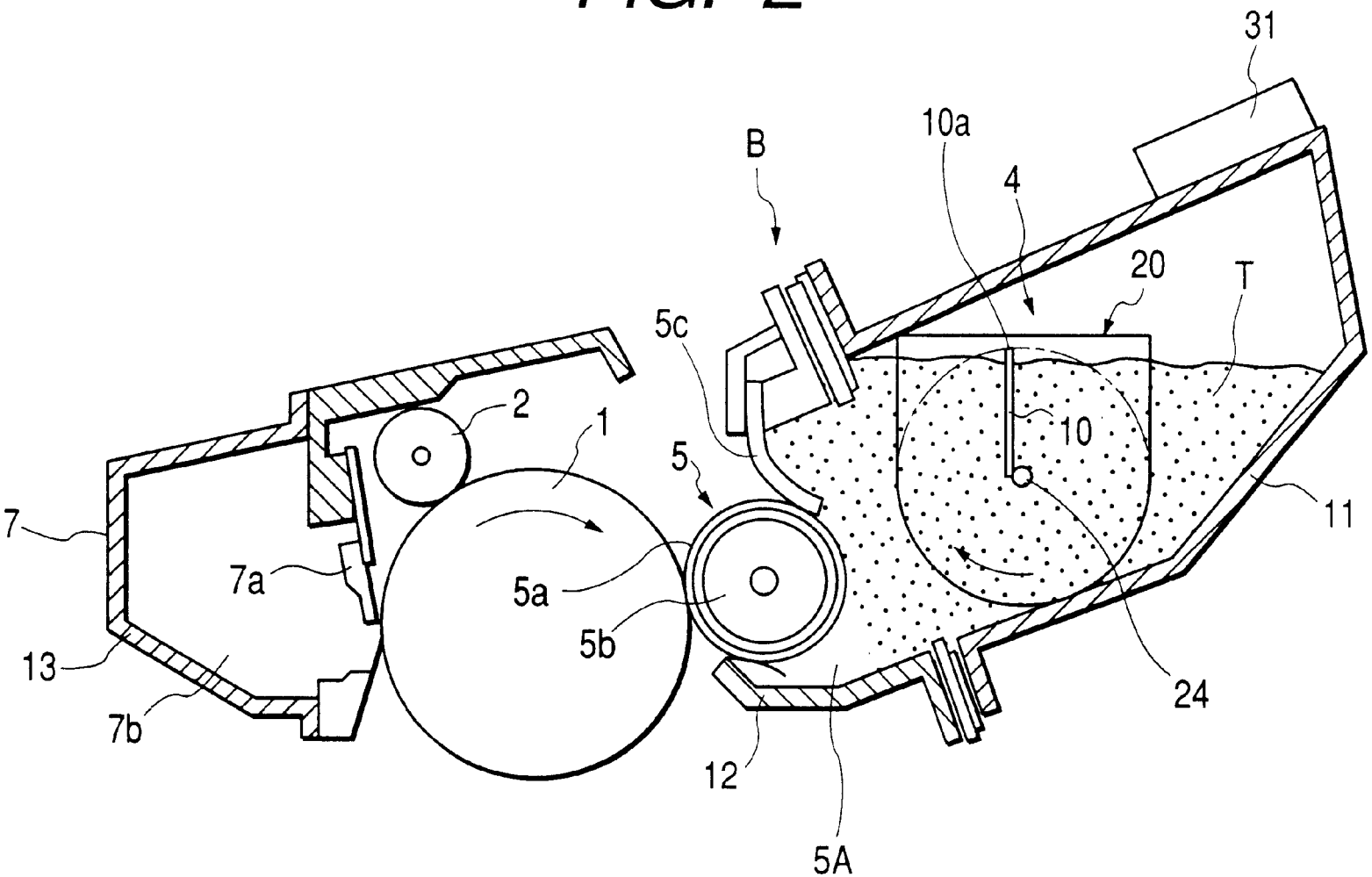
FIG. 2 is an enlarged sectional view of the process cartridge of FIG. 1.

Namely, according to the illustrated embodiment, as mentioned above, within the developer container 4, there is provided agitating means 10 rotated in a direction shown by the arrow in FIG. 1, and, when the agitating means are rotated, the developer T is supplied to the developing roller 5*a* while being disentangled. Further, as shown in FIG. 3, a flat antenna 20 as developer remaining amount means is provided on an inner side wall of the developer container 4.

The flat antenna 20 is constituted by forming two conductive patterns 22, 23 on a print substrate 21 generally used, by etching or printing. Further, a protection film (not shown) is coated on the conductive patterns 22, 23 to protect the circuit patterns. The conductive patterns may appropriately be set, and, in the illustrated embodiment, widths (W) of two conductive patterns 22, 23 of the flat antenna 20 are selected to be 300 $\mu$m and an interval or gap (G) between the conductive patterns 22, 23 is selected to be about 300 $\mu$m.

In the flat antenna 20 according to the illustrated embodiment, when AC bias (200 Vpp, 2000 Hz) was applied between the conductive pattern electrodes 22, 23, it was observed that a capacitance of 20 pF was obtained if the developer does not contact the flat antenna 20 and a capacitance of 60 pF was obtained if the developer contacts the entire surface of the flat antenna 20. By providing this flat antenna 20 on the inner side wall of the developer container 4, the contact area between the developer T and the flat antenna 20 is decreased as the developer T in the container 4 is decreased, and thus, by measuring the capacitance between two conductive patterns (antennas 22, 23), the amount of the developer T in the container 4 can always be known.

However, in actuality, when the developer T in the container 4 is gradually decreased, since the developer is slightly adhered to the flat antenna 20, dispersion in measurement result occurs.

In order to remove the developer adhering to the surface of the flat antenna, an antenna cleaning member 10*a* is provided at an end of the agitating means 10, thereby cleaning the surface of the flat antenna 20 during the rotation of the agitating means 10. For example, the antenna cleaning member 10*a* is formed from a PET (polyethylene telephthalate) sheet to sweep the surface of the flat antenna 20.

As shown in FIG. 3, the flat antenna 20 is provided at its center with a hole 24 through which a support shaft of the agitating means 10 is passed so that the agitating means are rotatably supported by the developer container 4, thereby cleaning substantially the entire area of the flat antenna 20 by means of the antenna cleaning member 10*a*.

With the above-mentioned arrangement, the dispersion in measurement result due to the developer slightly adhering to the flat antenna 20 can be eliminated. However, the output of the flat antenna 20 is fluctuated by the rotational period of the antenna cleaning member 10*a*.

In consideration of this, by effecting statistical treatment, for example, by averaging the output of the antenna or by selecting a minimum value of the output of the antenna, the developer remaining amount level is determined.

Figure 5:
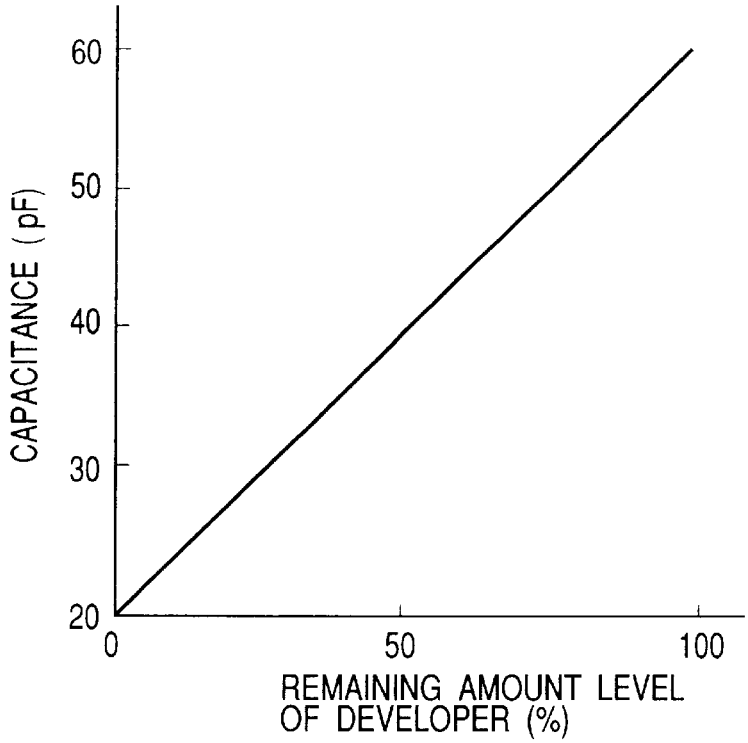
FIG. 5 is a graph showing the relationship between a developer remaining amount level and capacitance.

In consideration of the limitation of the measurement resolving power and the measurement error, regarding the resolving power for the developer remaining amount detection in the flat antenna system according to the illustrated embodiment, when it is assumed that the entire amount in the developer containing portion, i.e., the developer container 4 in a non-used or initial condition, is 100%, the developer remaining amount can be detected with a reduction ratio of 1%. The relationship between the remaining amount of developer and the capacitance is shown in FIG. 5.

According to the present invention, in addition to the developer remaining amount detection effected by the developer remaining amount detecting means 20 of flat antenna type, by using means for detecting the consumed amount of the developer by statistical calculation, the remaining amount level of the developer can be detected with higher resolving power. As the means for detecting the consumed amount of the developer by statistical calculation, in the illustrated embodiment, detecting means is provided for detecting the total time of laser illumination. Of course, the remaining amount level of the developer can be calculated statistically on the basis of print amount information corresponding to the image signal.

FIG. 4 shows the entire construction of the laser illumination total time detecting means 50 in the laser beam printer A of the present invention. The laser illumination total time detecting means 50 include a modulator 51 for modulating the image signal inputted from a computer into laser input voltage, thereby turning ON/OFF the laser in correspondence to the image signal.

A counter 52 is connected to the modulator 51 so that the output time from the modulator 51 to the laser, i.e., time information corresponding to exposure time of the laser beam to the photosensitive drum 1, is measured. That is to say, clock pulse generating means 53 as a crystal oscillator are connected to the counter 52 to count the number of clock pulses received during the duration of the laser illumination signal.

Figure 6:
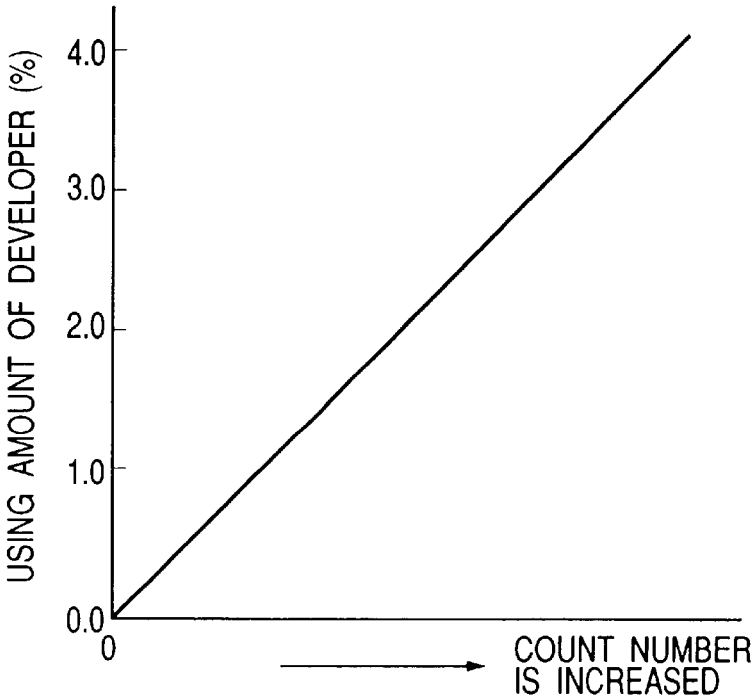
FIG. 6 is a graph showing the relationship between a count number and a using amount of developer.

By using statistical calculating means 54, the used amount of the developer is sought by the statistical calculation on the basis of the relationship between a pre-set count number and the used amount of the developer. Since this value is the statistical calculation value, the resolving power can be determined voluntarily. The relationship between the count number and the used amount of developer is shown in FIG. 6.

Further, according to the present invention, by writing the remaining amount level value of the developer in the developer container 4 on memory means 31 provided on the process cartridge B, even when a plurality of cartridges are exchanged and used, the developer remaining amount levels of the respective cartridges can be reserved. A read/write non-volatile memory was used as the memory means 31.

Figure 7:
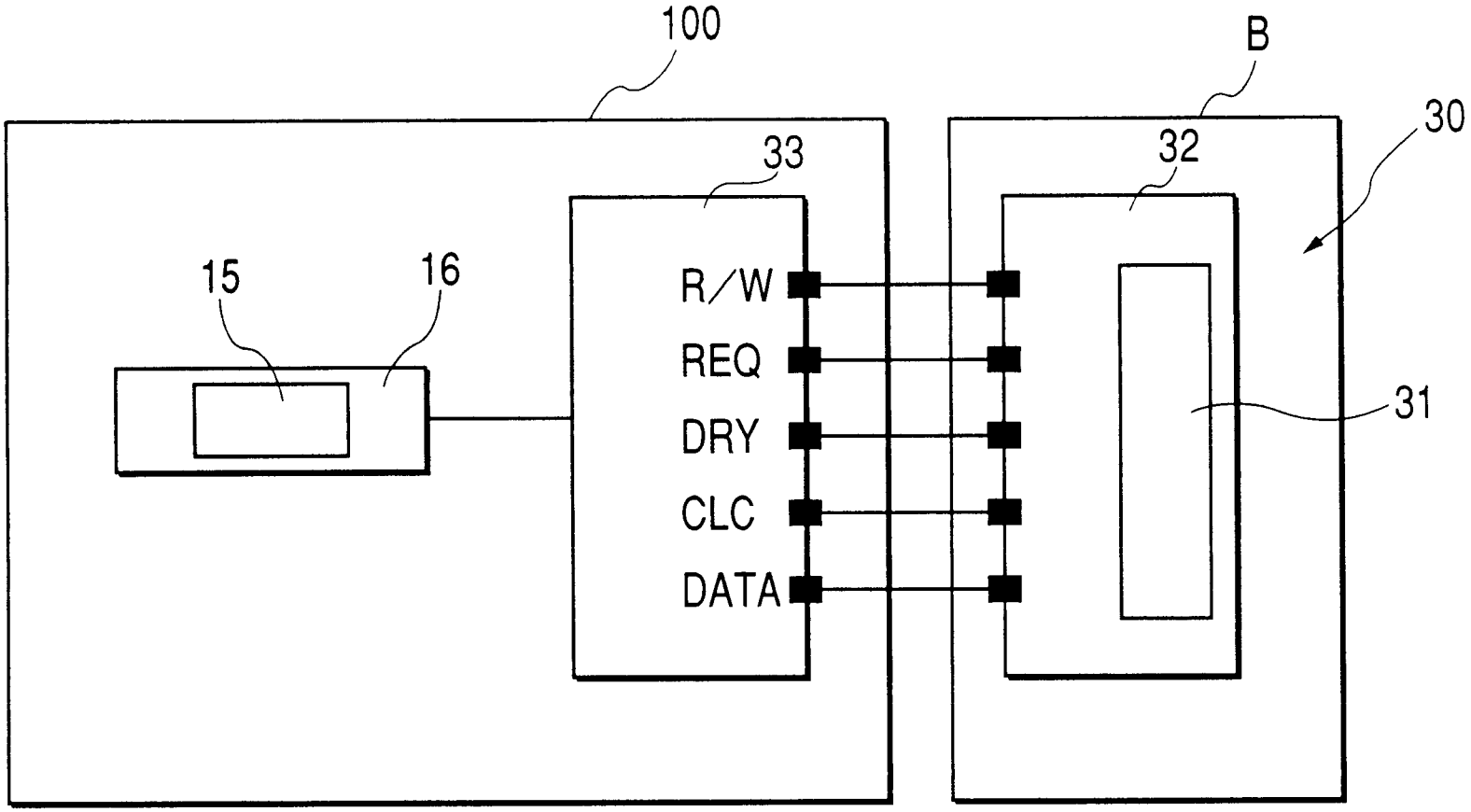
FIG. 7 is a schematic relational view for explaining the relationship between memory means provided in the process cartridge according to the present invention and display means provided on a main body of the image forming apparatus.

In the illustrated embodiment as shown in FIG. 7, the process cartridge B is provided with a non-volatile memory 31 as the memory means, and a cartridge side control portion 32 for controlling the reading/writing of information with respect to the non-volatile memory 31. When the process cartridge B is mounted to the main body 100 of the image forming apparatus, the cartridge side control portion 32 and a control portion 33 of the main body side of the image forming apparatus are interconnected via R/W, REQ, DRY, CLC and DATA signal lines. In this way, the control portion 33 of the main body side of the image forming apparatus and the cartridge side control portion 32 constitute control means for effecting the reading/writing of the information with respect to the memory means 31.

In reading and writing data with respect to the non-volatile memory 31 as the memory means, in dependence upon the property of the device used, an appropriate waiting time is set, thereby ensuring the operation of the device.

Figure 8:
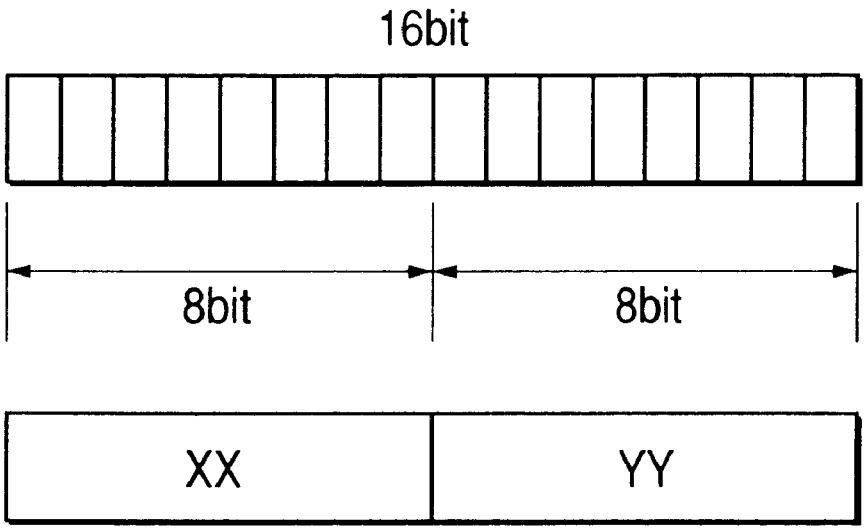
FIG. 8 is a view for explaining an example of reading/writing of information with respect to memory means used in the present invention.

As shown in FIG. 8, the non-volatile memory 31 used in the illustrated embodiment is a memory of the serial-data-input type having a memory capacity of 16 bits. The 16 bits are used by dividing them into front half 8 bits and rear half 8 bits. Accordingly, separate data can be stored in the respective 8-bit areas. Integral numbers from 0 to 100 can be represented well by an 8-bit capacity.

The remaining amount level of the developer in the developer container 4 detected by the developer remaining amount detecting means 20 of flat antenna type is written in the front half 8-bit area of the non-volatile memory 31. From the resolving power of the developer remaining amount detecting means 20 of flat antenna type, the remaining amount level of the developer is determined as XX% and a number of two figures as XX is written. In the non-used condition, since 100% of the developer is present, a number of three figures as XXX is written.

The consumed amount of the developer calculated by the laser illumination total time detecting means 50 is written in the rear half 8-bit area of the non-volatile memory 31. Since the value calculated by the laser illumination total time detecting means 50 is a statistical calculation value and the resolving power can be set voluntarily, when the entire amount of the developer in the developer container 4 is regarded as 100%, calculation can be effected with a reduction ratio of O.YY%. Thus, a number of two figures as YY is written.

In this way, two information data, which are information regarding the amount of the developer, i.e., a detected value of a developer remaining amount detected by the developer remaining amount detecting means 20, and the calculated value of the developer consumed amount calculated by the means for detecting the developer consumed amount on the basis of the statistical calculation, are written in the non-volatile memory 31 provided on the process cartridge B.

Namely, the developer amount as XX.YY% is stored, and the detection result detected by the developer remaining amount detecting means is used in the high order (left) figures XX of the number XX.YY and the calculation value calculated by the laser illumination total time detecting means 50 for detecting the consumed amount of the developer based on the statistical calculation is used in the lower order (right) figures .YY.

As shown in FIGS. 1 and 5, the main body 100 of the image forming apparatus is provided with display means 15 and a display control portion 16 for informing the operator of the remaining amount level of the developer. The display means 15 and the display control portion 16 serve to read out the information regarding the amount of the developer from the nonvolatile memory 31 as the memory means provided on the process cartridge, via the control portion 33 of the main body side of the image forming apparatus and the cartridge side control portion 32. As mentioned above, although the information regarding the remaining amount level of the developer can be displayed by the display means 15 of the main body 100 of the apparatus, a developer remaining amount level signal may be outputted and sent to a personal computer to be displayed on a display of the personal computer.

As mentioned above, the information regarding the developer amount is constituted by two values. In this case, in the illustrated embodiment, in the display control portion, the calculation (XX.OO−O.YY)=ZZ.ZZ is effected, and a difference ZZ.ZZ is displayed. In the non-used condition of the developer, since 100% of the developer is the present, XXX.O or ZZZ.Z can be displayed.

Any formula can be used as the calculation equation. Namely, from the high order figures XX of the number as the detection result detected by the developer remaining amount level detecting means 20 and the lower figures .YY as the calculation value calculated by the means 50 for detecting the developer consumed amount based on the statistical calculation, the remaining amount level of the developer is combined, and the result is displayed on the display means 15 of the main body 100 of the apparatus or the display of the personal computer.

Figure 10:
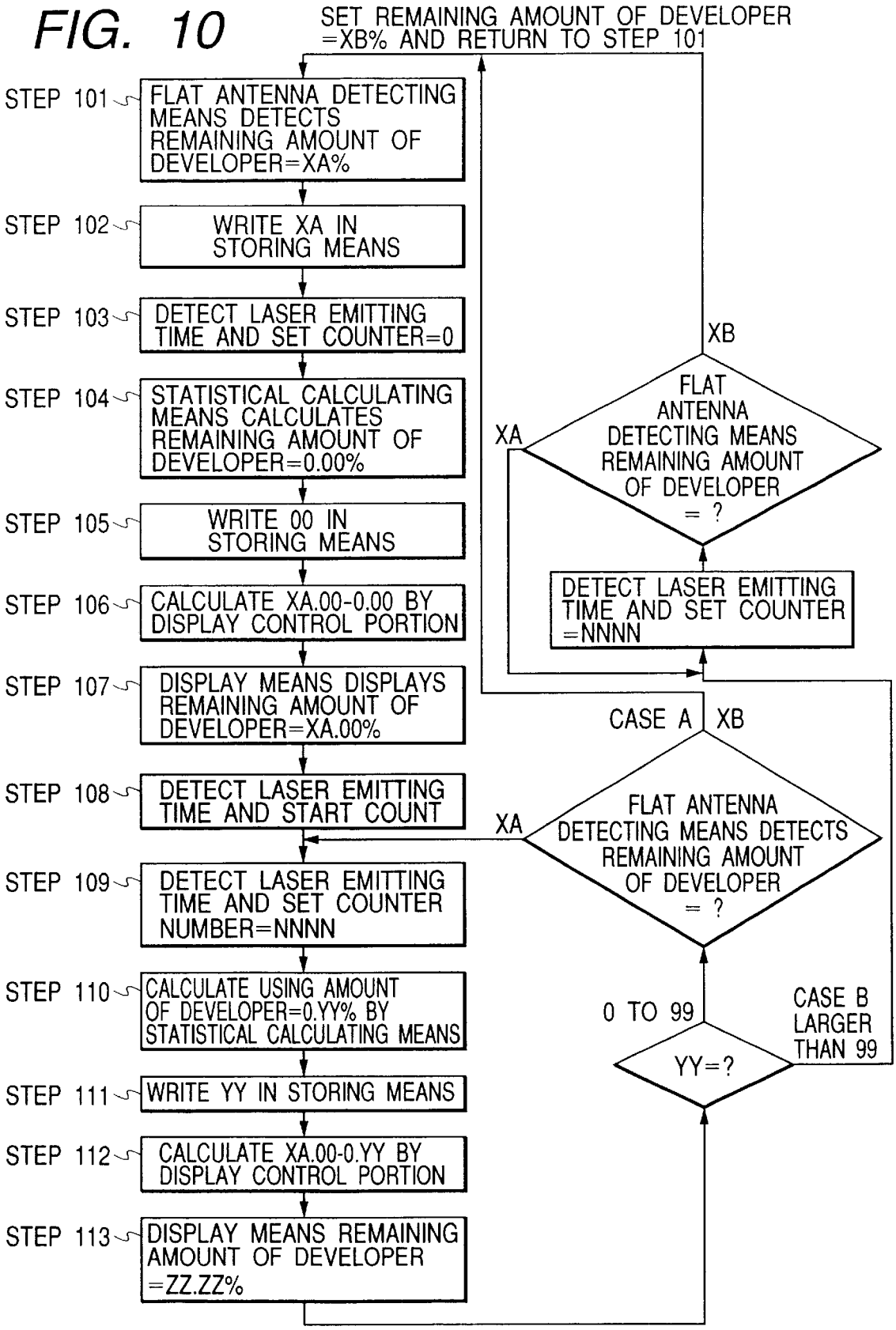
FIG. 10 is a flow chart for explaining a developer amount detecting method according to the present invention.

Next, an operation of the image forming apparatus according to the illustrated embodiment will be explained by using the flow chart shown in FIG. 10. For clarity's sake, it is assumed that a time point when the developer detecting apparatus 30, i.e., the developer remaining amount detecting means 20 detects the fact that the remaining amount of the developer is changed is a start point.

Step 101:

The developer remaining amount detecting means 20 detect the fact that the remaining amount level of the developer in the developer container is XA% at present.

Step 102:

"XA" is written in the front half 8-bit area of the memory means, i.e., non-volatile memory 31 provided on the process cartridge B.

Step 103:

The counter of the laser illumination total time detecting means 50 is reset to obtain "counter=0".

Step 104:

The statistical calculation means 50 receives "counter=0" and calculates "using amount of developer=0.00%".

Step 105:

"00" is written in the rear half 8-bit area of the non-volatile memory 31 provided on the process cartridge B.

Step 106:

The display control portion 16 reads out the information regarding the developer amount from the non-volatile memory 31 and executes calculation (XA.OO−0.00).

Step 107:

The display means 15 or the display of the personal computer displays the remaining amount of the developer (=XA.OO%).

Step 108:

The counter 52 connected to the clock pulse generating means 53 starts to count the number of clock pulses regarding the output time from the modulator 51 to the laser, i.e., the time information corresponding to the exposure time of the laser beam onto the photosensitive drum 1.

Step 109:

The number of clock pulses are counted until the count number becomes NNNN.

Step 110:

The statistical calculation means 53 receives the count number=NNNN and calculates the fact that the used amount of the developer is O.YY%.

Step 111:

"YY" is written in the rear half 8-bit area of the non-volatile memory 31 provided on the process cartridge B.

Step 112:

The display control portion 16 reads out the information regarding the developer amount and executes a calculation (XA.OO−O.YY).

Step 113:

The display means 15 or the display of the personal computer displays the remaining amount of the developer (=ZZ.ZZ%). ZZ.ZZ is the calculation result of (XA.OO−O.YY).

The above steps 101 to 113 are repeated to successively effect the writing/reading of the information regarding the remaining amount of the developer with respect to the non-volatile memory 31, and the remaining amount of the developer which is ZZ.ZZ% is displayed on the display means 15 or the display of the personal computer to inform the operator of the remaining amount of the developer.

The steps 109 to 113 are repeated until YY becomes 99 at the maximum.

Here, in consideration of the resolving power of the developer remaining amount detecting means 20 of flat antenna type, the following two cases can be considered.

In a first case (A), before YY=99, the developer remaining amount detecting means 20 of flat antenna type detects the fact that the remaining amount of the developer is XB% (B=A−1). In this case, immediately after the detection, the program is returned to the step 101 to reset the counter 52, and the above steps are repeated.

In a second case (B), even YY=99, and the developer remaining amount detecting means 20 of the flat antenna type does not detect the fact that the remaining amount of the developer is XB% (B=A−1). In this case, while the counter 52 continues to count, the consumed amount of the developer calculated by the statistical calculation is not written on the nonvolatile memory 31. Thus, YY=99 is maintained and the display means or the display of the personal computer is not renewed.

Namely, the value detected by the developer remaining amount detecting means 20 renews only the value newly detected by the detecting means 20, and the calculation value of the consumed amount of the developer calculated by the statistical calculation is not reflected. The high order figures XX is always the value detected by the developer remaining amount detecting means 20. This is similar in the writing of the information regarding the developer amount on the memory means 31, and the remaining amount level of the developer in the developer container 4 detected by the developer remaining amount detecting means 20 of the flat antenna type is always written in the front half 8-bit area of the non-volatile memory 31, and the consumed amount of the developer calculated by the laser illumination total time detecting means 50 is not written, and the data written in the front (left) half 8-bit area is not renewed by the consumed amount of the developer calculated by the detecting means 50.

As mentioned above, in addition to the developer remaining amount detecting means 20, by using the means 50 for detecting the consumed amount of the developer by the statistical calculation, the detection of the developer remaining amount level with high resolving power can be achieved. Further, the detection amount of the developer remaining amount obtained from the developer remaining amount detecting means 20 and the calculation amount of the developer consumed amount obtained by the statistical calculation are stored in the memory means 31 provided on the process cartridge B, respectively. In this case, in consideration of the capacity of the memory means 31, the pieces of information regarding the developer remaining amount levels are written in the front and rear (right) half areas, respectively.

The pieces of information regarding the developer remaining amount levels written in the respective areas are independent, and, in particular, the information regarding the remaining amount level of the developer written in the area on which the detection value of the developer remaining amount obtained from the developer remaining amount detecting means 20 was written is not renewed by the calculation value of the developer consumed amount obtained by the statistical calculation.

In this way, even when a plurality of cartridges are exchanged, the developer remaining amount levels of the respective cartridges can be reserved.

Further, in the illustrated embodiment, while an example that the reading/writing of the information with respect to the memory means 31 provided on the process cartridge B is controlled by the control portion 33 of the main body 100 of the image forming apparatus and the cartridge side control portion 33 was explained, both of the control portions 32, 33 may be provided on the process cartridge B.

Further, in the illustrated embodiment, while the signal processing means 53 for effecting the statistical processing of the output signal of the developer remaining amount detecting means 20 and for defining the signal as the developer remaining amount level was provided on the main body 100 of the image forming apparatus, such means 53 may be provided on the process cartridge B.

Incidentally, in the illustrated embodiment, while an example that the flat antenna system as one aspect of the capacitance detecting system is used as the developer remaining amount detecting means was explained, the present invention is not limited to the developer remaining amount detecting means of this type. So long as the developer remaining amount level can be detected, the type of the detecting means are not limited, and, thus, the plate antenna type or the torque detecting type already described in connection with the prior art may be used.

Second Embodiment

In a second embodiment of the present invention, a process cartridge containing a total amount of developer of 1000 grams in a non-used condition will be explained.

As is in the first embodiment, also in this second embodiment, in order to achieve detection of the developer remaining amount level with high resolving power and to correctly inform the operator of a developer remaining amount level even when the process cartridge is exchanged for a new one, the image forming as apparatus is provided with means for detecting the consumed amount of developer based on a statistical calculation, and the process cartridge is provided with developer remaining amount detecting means 20 and a memory means 31.

Further, similar to the first embodiment, developer remaining amount detecting means of the flat antenna type is used as the developer remaining amount detecting means 20 and laser illumination total time detecting means 50 is used as means for detecting the consumed amount of developer on the basis of a statistical calculation, and, further, by writing the value of the remaining amount of the developer in the developer container 4 on a read/write non-volatile memory 31 as the memory means provided on the process cartridge B, even when a plurality of cartridges are exchanged, developer remaining amount levels of the respective cartridges can be reserved. Thus, explanation thereof will be omitted.

As is in the illustrated embodiment, in case of the process cartridge containing the developer having a total amount of 1000 grams in the non-used condition, the resolving power of the developer remaining amount detecting means 20 of the flat antenna type can detect the developer remaining amount with a reduction ratio of 10 grams. In addition to the detection of the developer remaining amount effected by the resolving power of the developer remaining amount detecting means 20 of the flat antenna type, by using the laser illumination total time detecting means 50, the detection of the developer remaining amount level can be performed with higher resolving power.

As mentioned above, although the used amount of the developer is sought on the basis of a statistical calculation from the relationship between the used amount of the developer and the count number previously set in the laser illumination total time detecting means 50, since the statistical calculation is used, the resolving power can be determined voluntarily.

Figure 9:
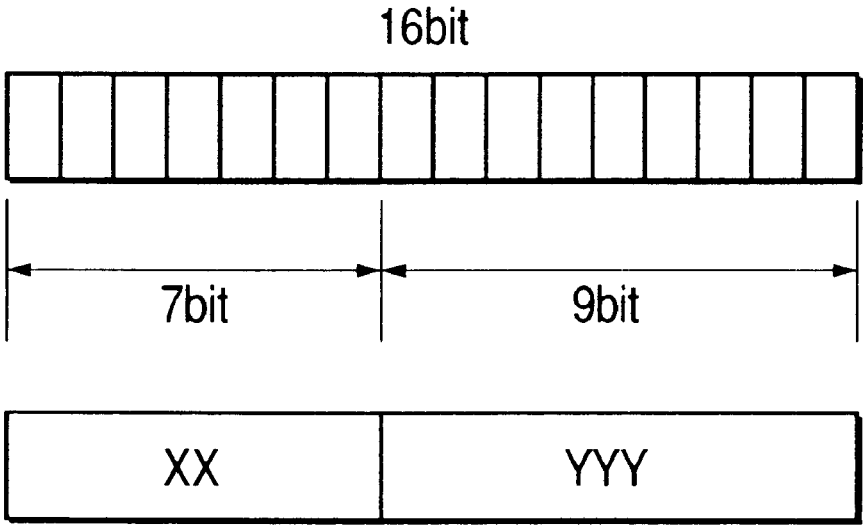
FIG. 9 is a view for explaining another example of the reading/writing of the information with respect to the memory means used in the present invention.

Also in this embodiment, the non-volatile memory 31 is a memory of the serial data input/output type having a memory capacity of 16 bits. However, the memory means are not limited to such a memory. In the illustrated embodiment, as shown in FIG. 9, a 16 bit area is divided into a front 7-bit area and a rear 9-bit area. Accordingly, separate or discrete data can be stored in the respective areas. The capacity of the front 7-bit area can represent an integral number from 0 to 100 and the capacity of the rear 9-bit area can represent an even number from 0 to 1000. In order to represent the integral number from 0 to 1000, the capacity of the non-volatile memory 31 can be increased.

The remaining amount of the developer in the developer container detected by the developer remaining amount detecting means 20 of the flat antenna type is written in the front 7-bit area of the non-volatile memory 31. Since the developer remaining amount detecting means 20 of the flat antenna type has a resolving power of 10 grams, the remaining amount of the developer is detected with XXO g (the lowest figure is zero). Thus, two figures XX (three figures XXXO g are written in the non-used condition because 1000 grams of developer are present) are written.

The consumed amount of the developer calculated by the laser illumination total time detecting means 50 is written in the rear 9-bit area of the non-volatile memory 31. Since this value is a statistical calculation value and the revolving power can be set voluntarily, the calculation can be effected with a reduction ratio of Y.YY grams. Accordingly, an even number having three figures YYY is written.

In this way, two pieces of information regarding the amounts of the developer, i.e., the detection value of the developer remaining amount level detected by the developer remaining amount detecting means 20 and the calculation value of the developer consumed amount calculated by the means for detecting the consumed amount of the developer on the basis of the statistical calculation, are written in the non-volatile memory 31 provided on the process cartridge B. Namely, the developer amount of XXX.YY grams is stored, and the detection result from the developer remaining amount detecting means 20 is used in high order figures XX of the number XXX.YY and the calculation value calculated by the means 50 for detecting the consumed amount of the developer on the basis of the statistical calculation is used in lower order figures Y.YY.

As shown in FIGS. 1 and 7, the image forming apparatus A is provided with display means 15 and a display control portion 16 for informing the operator of the remaining amount level of the developer. Similar to the first embodiment, the display means 15 and the display control portion 16 serve to read out the information regarding the amount of the developer from the non-volatile memory 31 as the memory means provided on the process cartridge, via the control portion 33 of the main body of the image forming apparatus and the cartridge side control portion 32. Of course, the information regarding the remaining amount of the developer can be displayed on a display of a personal computer.

As mentioned above, the information regarding the amount of the developer is constituted by two values. In this case, according to the illustrated embodiment in the display control portion 16, calculation (XXO.OO−Y.YY)=ZZZ.ZZ is effected, and a difference ZZZ.ZZ g is displayed. Because 1000 grams of developer is present in the unused condition, XXXO or ZZZZ.Z can be displayed.

Any formula can be used as the calculation equation. Namely, from the high order figures XX of the number as the detection result detected by the developer remaining amount detecting means 20 and the low figures Y.YY as the calculation value calculated by the means 50 for detecting the developer consumed amount on the basis of the statistical calculation, the remaining amount level of the developer is combined and is displayed.

The operation of the second embodiment is carried out in the substantially similar manner to that shown in the flow chart explained in connection with the first embodiment, and, thus, explanation thereof will be omitted.

The value detected by the developer remaining amount detecting means 20 renews only the value newly detected by the detecting means, and the calculation value of the consumed amount of the developer calculated by the statistical calculation is not reflected. The high order figures XX is always the value detected by the developer remaining amount detecting means 20. This is similar in the writing of the information regarding the developer amount on the memory means 31, and the remaining amount level of the developer in the developer container 4 detected by the developer remaining amount detecting means 20 of flat antenna type is always written in the front 7-bit area of the non-volatile memory 31, and the consumed amount of the developer calculated by the laser illumination total time detecting means 50 is not written, and the data written in the front 7-bit area is not renewed by the consumed amount of the developer calculated. This is similar to the first embodiment.

As mentioned above, in addition to the developer remaining amount detecting means 20, by using the means 50 for detecting the consumed amount of the developer by the statistical calculation, the detection of the developer remaining amount level with high resolving power can be achieved. Further, the detection amount of the developer remaining amount obtained from the developer remaining amount detecting means 20 and the calculation amount of the developer consumed amount obtained by the statistical calculation are stored in the memory means 31 provided on the process cartridge B, respectively. In this case, in consideration of the capacity of the memory means 31, the pieces of information regarding the developer remaining amount levels are written in the front and rear areas, respectively.

The pieces of information regarding the developer remaining amount levels written in the respective areas are independent, and, in particular, the information regarding the remaining amount level of the developer written in the area on which the detection value of the developer remaining amount obtained from the developer remaining amount detecting means 20 was written is not renewed by the calculation value of the developer consumed amount obtained by the statistical calculation.

In this way, even when a plurality of cartridges are exchanged, the developer remaining amount levels of the respective cartridges can be reserved.

Further, in the illustrated embodiment, while an example that the reading/writing of the information with respect to the memory means 31 provided on the process cartridge is controlled by the control portion 33 of the main body 100 of the image forming apparatus and the cartridge side control portion 33 was explained, both of the control portions 32, 33 may be provided on the process cartridge B.

In the illustrated embodiment, while an example that the flat antenna system as one aspect of the capacitance detecting system is used as the developer remaining amount detecting means 20 was explained, the present invention is not limited to the developer remaining amount detecting means of this type. So long as the developer remaining amount level can be detected, the type of the detecting means are not limited, and, thus, the plate antenna type or the torque detecting type already described in connection with the prior art may be used. This is similar to the first embodiment.

Third Embodiment

Figure 11:
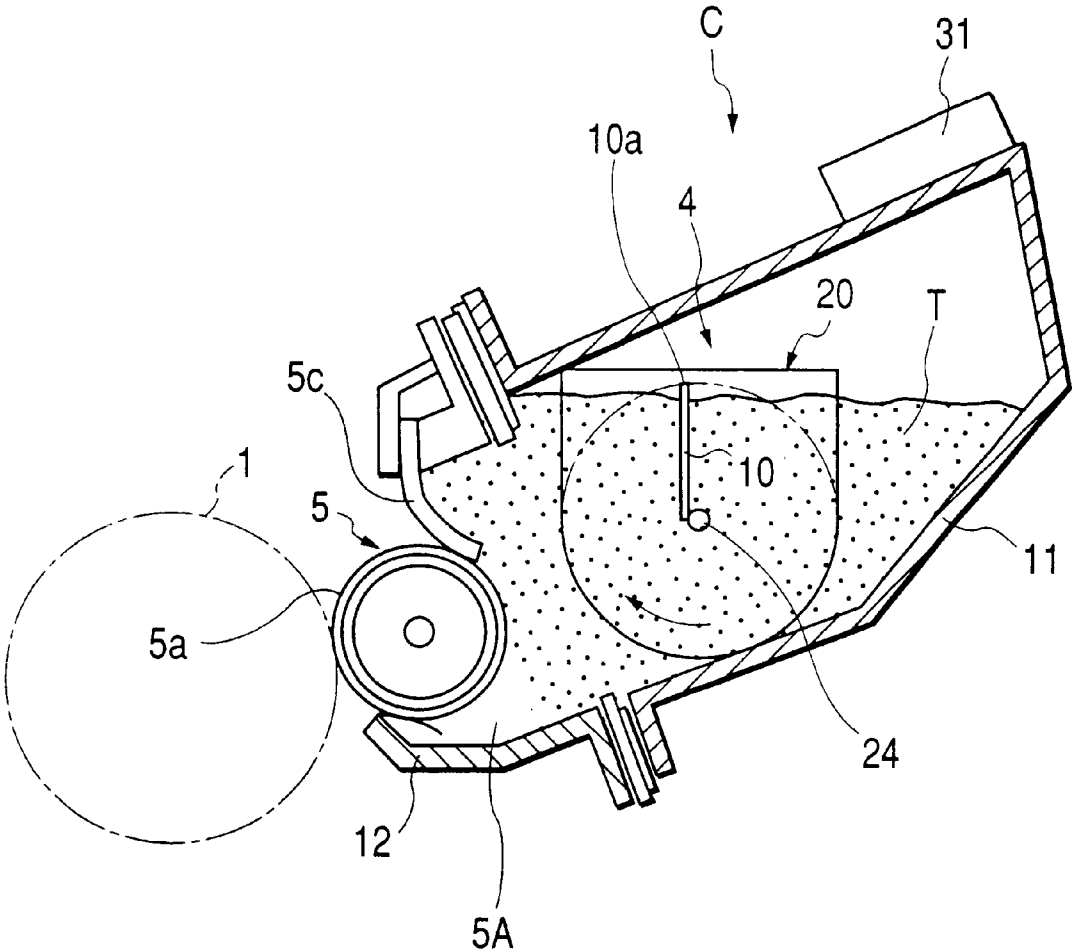
FIG. 11 is a sectional view showing an embodiment a developing apparatus embodied as a cartridge according to the present invention.

FIG. 11 shows an embodiment of a developing apparatus C formed as a cartridge according to another aspect of the present invention.

The developing apparatus C according to this embodiment is constituted as a cartridge by using plastic developing frame 11, 12 to have a developer carrying member such as a developing roller 5*a* and a developing chamber 5A containing developer therein in order to supply the developer to the developer carrying member. That is to say, this cartridge can be regarded as a cartridge obtained by removing the photosensitive drum 1, charging means 2 and cleaning means 7 from the aforementioned process cartridge B. Accordingly, all of the construction of the developing apparatus and the construction of the developer amount detecting means explained in connection with the first and second embodiments are applied to the developing apparatus according to this embodiment. Therefore, such constructions and functions, i.e., the developer remaining amount calculating system and the remaining amount displaying system, will be omitted from explanation.

Also in this embodiment, the same effect as those in the first and second embodiments can be achieved.

The present invention is not limited to the aforementioned embodiments, but various alteration and modifications can be made within the technical idea.

What is claimed is:

1. An image forming apparatus comprising:

a developer container for containing a developer;

developer amount detecting means for detecting an amount of the developer contained in said developer container;

consumed amount calculating means for calculating a consumed amount of the developer; and remaining amount calculating means for calculating a remaining amount of the developer in said developer container by combining an output of said detecting means and an output of said consumed amount calculating means.

2. An image forming apparatus according to claim 1, wherein a resolving power of said consumed amount calculating means is higher than a resolving power of said detecting means.

3. An image forming apparatus according to claim 2, wherein said remaining amount calculating means calculates a high order figure of the remaining amount in accordance with the output of said detecting means and calculates a low order figure of the remaining amount in accordance with the output of said consumed amount calculating means.

4. An image forming apparatus according to claim 1, wherein said consumed amount calculating means calculates the consumed amount in accordance with an amount of an image signal.

5. An image forming apparatus according to claim 4, further comprising a laser scanner illuminated in response to the image signal, wherein said consumed amount calculating means calculates the consumed amount of the developer based on the laser illumination time.

6. An image forming apparatus according to claim 1, further comprising display means for displaying the remaining amount of the developer calculated by said remaining amount calculating means.

7. An image forming apparatus according to claim 1, wherein said image forming apparatus is used in connection with an electronic equipment having a display, and the remaining amount of the developer calculated by said remaining amount calculating means is displayed on the display.

8. An image forming apparatus according to claim 1, further comprising a memory, wherein said memory stores information regarding the amount of the developer detected by said detecting means and information calculated by said consumed amount calculating means.

9. A cartridge detachably mountable on an image forming apparatus, comprising:

a developer container; and a memory for storing information of an amount of developer detecting by detecting means for detecting the amount of the developer contained in said developer container and information calculated by consumed amount calculating means for calculating a consumed amount of the developer;

wherein the information regarding the amount of the developer affect a high order figure of display of a remaining amount of the developer, and the information calculated by said consumed amount calculating means affect a low order figure of display of the remaining amount of the developer.

10. A cartridge according to claim 9, further comprising an electrophotosensitive member, and at least one of charging means for charging said electrophotosensitive member, developing means for supplying the developer to said electrophotosensitive member and cleaning means for cleaning said electrophotosensitive member.

* * * * *

UNITED STATES PATENT AND TRADEMARK OFFICE

CERTIFICATE OF CORRECTION

PATENT NO. : 6,347,198 B1
DATED : February 12, 2002
INVENTOR(S) : Shinya Yamamoto et al.

It is certified that error appears in the above-identified patent and that said Letters Patent is hereby corrected as shown below:

Column 4,
Line 24, “embodiment a” should read -- embodiment of a --.
Line 46, “an” should read -- a --.

Signed and Sealed this

Twelfth Day of November, 2002

*Attest:*

*Attesting Officer*

JAMES E. ROGAN
*Director of the United States Patent and Trademark Office*